US007424119B2

(12) United States Patent
Reichel

(10) Patent No.: US 7,424,119 B2
(45) Date of Patent: Sep. 9, 2008

(54) VOICE MATCHING SYSTEM FOR AUDIO TRANSDUCERS

(75) Inventor: Kenneth Reichel, Hudson, OH (US)

(73) Assignee: Audio-Technica, U.S., Inc., Stow, OH (US)

( * ) Notice: Subject to any disclaimer, the term of this patent is extended or adjusted under 35 U.S.C. 154(b) by 978 days.

(21) Appl. No.: 10/651,872

(22) Filed: Aug. 29, 2003

(65) Prior Publication Data

US 2005/0047610 A1 Mar. 3, 2005

(51) Int. Cl.
*H04R 27/00* (2006.01)

(52) U.S. Cl. ..... 381/85; 381/91; 381/76; 381/334; 381/81

(58) Field of Classification Search ..... 381/91, 381/312–313, 122, 95, 111, 113, 77, 81–82, 381/85, 344, 92, 334–335, 76, 321, 333
See application file for complete search history.

(56) References Cited

U.S. PATENT DOCUMENTS 5,206,913 A 4/1993 Sims
5,471,195 A * 11/1995 Rickman ..... 340/550
5,987,488 A * 11/1999 Harrand et al. ..... 708/520
6,385,323 B1 * 5/2002 Zoels ..... 381/313
6,421,448 B1 * 7/2002 Arndt et al. ..... 381/312
6,757,385 B1 * 6/2004 Ehrenstråle et al. .... 379/406.14
7,346,176 B1 * 3/2008 Bernardi et al. ..... 381/92
2002/0039425 A1 4/2002 Burnett et al.
2003/0040908 A1 2/2003 Yang et al.
2003/0147538 A1 * 8/2003 Elko ..... 381/92
2003/0198356 A1 * 10/2003 Thompson ..... 381/92
2004/0057593 A1 * 3/2004 Pedersen et al. ..... 381/321
2005/0276423 A1 * 12/2005 Aubauer et al. ..... 381/92

FOREIGN PATENT DOCUMENTS

DE 19818611 9/1999
DE 19849739 5/2000
EP 1081985 A2 3/2001

* cited by examiner

*Primary Examiner*—Vivian Chin
*Assistant Examiner*—Disler Paul
(74) *Attorney, Agent, or Firm*—Welsh & Katz, Ltd.

(57) ABSTRACT

A method and apparatus are provided for matching an output of an auxiliary signal transducer with a reference signal transducer where the auxiliary signal transducer and reference signal transducer receive audio signals from a common signal source along different respective signal paths. The method includes the steps of determining a signal amplitude output value provided by the auxiliary and by the reference transducers within each of a plurality of different frequency ranges in response to the audio signal received along the respective signal paths and adjusting the signal amplitude output value of the auxiliary transducer within at least some of the plurality of different frequency ranges based upon the respective signal amplitude output value of the reference transducer.

32 Claims, 1 Drawing Sheet

VOICE MATCHING SYSTEM FOR AUDIO TRANSDUCERS

FIELD OF THE INVENTION

The field of the invention relates to public address systems and more particularly, to the use of multiple microphones by a single speaker.

BACKGROUND OF THE INVENTION

The use of a microphone and sound amplification system is a necessary part of any speaking event involving any more than about 50 people. Typically, a speaker is provided with a podium-mounted microphone coupled to an amplifier. A set of audio speakers, coupled to the amplifier, are distributed around an audience space to amplify the speaker's voice.

In other instances, where the speaker requires mobility to move around a room (e.g., to write on a blackboard, interact with the audience, etc.) a portable microphone (e.g., a wireless microphone) may be used. A wireless microphone functions by incorporating a wireless rf transmitter into the microphone along with a set of batteries. A nearby receiver operates to receive the rf signal and couple the speaker's voice into the amplifier.

One type of portable microphone is referred to as a lavalier microphone. A lavalier microphone is not typically handheld; but, instead, may be attached to the user's clothing. While lavalier microphones may be either wired or wireless, they are usually wireless.

While lavalier microphones are often more convenient to use than handheld or podium-mounted microphones, they are also prone to more noise and interference. One of the reasons for the additional noise and interference is that the microphone is not located directly in front of, or even very near, the mouth of the speaker. Because of the separation, the sound from a lavalier microphone may often seem muffled and more susceptible to room noise.

However, even with the drawbacks of lavalier microphones, a speaker is often constrained to use such devices because of the flexibility provided. Because of the importance of flexibility in public speaking, a need exists for a lavalier microphone that is more adaptable to its location.

SUMMARY

A method and apparatus are provided for matching an output of an auxiliary signal transducer with a reference signal transducer where the auxiliary signal transducer and reference signal transducer receive audio signals from a common signal source along different respective signal paths. The method includes the steps of determining a signal amplitude output value provided by the auxiliary and by the reference transducers within each of a plurality of different frequency ranges in response to the audio signal received along the respective signal paths and adjusting the signal amplitude output value of the auxiliary transducer within at least some of the plurality of different frequency ranges based upon the respective signal amplitude output value of the reference transducer.

DETAILED DESCRIPTION OF AN ILLUSTRATED EMBODIMENT

Figure 1:
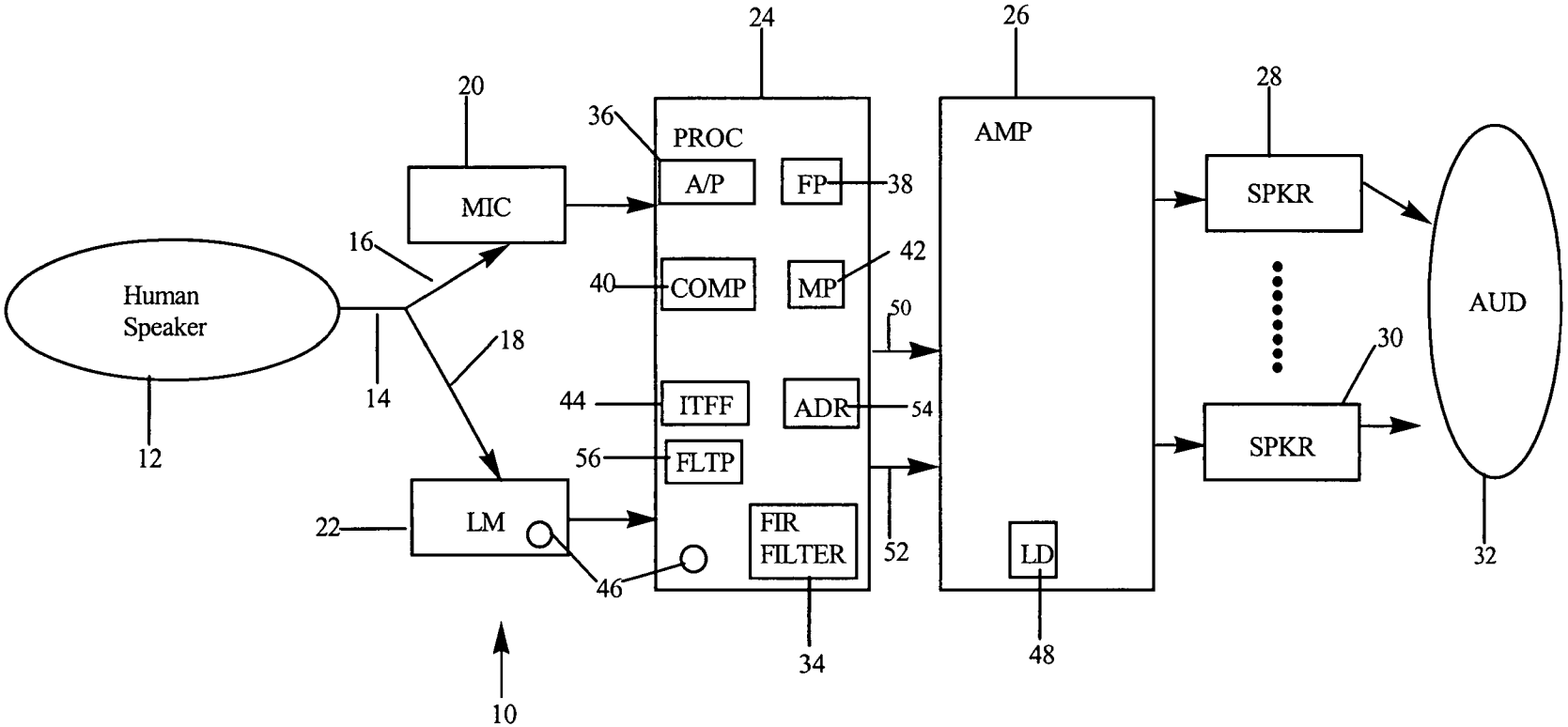
FIG. 1 depicts a system for matching an output of an auxiliary signal transducer with a reference signal transducer under an illustrated embodiment of the invention.

As shown in FIG. 1, an audio signal 14 from a human speaker 12 may travel along a first acoustic path 16 to a first, reference microphone (e.g., a podium-mounted microphone) and along a second acoustic path 18 to an auxiliary (e.g., a lavalier microphone) 22.

From one of the microphones 20, 22, the audio signal may be converted into an electrical equivalent of the audio signal and forwarded to a signal processor 24 where the signal may be subject to certain processing routines (e.g., filtering) to improve the audio characteristics of the reproduced audio signal. From the processor 24, the processed audio signal may be amplified in an amplifier 26 and applied to a set of audio speakers 28, 30. Within the speakers 28, 30, the electrical signal is converted back into the audio signal heard by the audience 32.

In use, the speaker 12 may stand at a podium (not shown) and speak directly into the podium-mounted microphone 20. Upon detection of an audio signal above some threshold value, the podium-mounted microphone 20 may be selected as the signal source for presentation to the audience 32.

Alternatively, the speaker 12 may walk away from the podium microphone 20. As the speaker 12 walks away from the podium-mounted microphone 20, the processor 24 (or a level detector 48 within the amplifier 26) may detect the decrease in signal energy from the podium-mounted microphone 20 and automatically select the lavalier microphone 22 as the signal source. The lavalier microphone 22 may be either wire-based or wireless.

While this process could be used to allow the speaker 12 greater mobility, what has not been generally recognized is that there may be a change in the amplified voice of the speaker 12 as the speaker 12 walks away from the podium. The change, in general, may be characterized as being caused by a change in distance between the speaker's mouth and microphone and in the orientation of the speaker's mouth with respect to the microphone. While this change may be subtle, it may still be distracting to some people.

Under an illustrated embodiment of the invention, the signal processor 24 may periodically measure a signal output from both the podium-mounted microphone 20 and lavalier microphone 22. Following measurement of the outputs, the processor 24 may detect any difference, and adjust a set of coefficients within a filter 34 to substantially eliminate any spectral differences in the output from the two microphones 20, 22.

Since the podium-mounted microphone 20 may be located directly in front of the speaker 12 during use, it would be expected to provide a more accurate conversion of impinging acoustic energy into an electrical representation of such acoustic signal. In contrast, the lavalier microphone 22 may be mounted somewhere on the speaker's chest and not be in direct line-of-sight with the speaker's mouth.

Because of the difference in distance and orientation, the voice 14 of the speaker 12 may undergo significant degradation along the path 18 to the lavalier microphone 22 that would not be seen along the line-of-sight path 16 to the podium microphone 20. For example, the lack of direct line-of-sight would necessarily result in a degradation in the timbre and high frequency components of the audio signal 14 along path 18. Further, when the lavalier microphone 22 is partially covered by the speaker's clothing, a further deterioration of spectral content and amplitude may be experienced.

In order to correct the deterioration of acoustic signal quality caused by the location of the lavalier microphone 22, the processor 24 may initially (or periodically) adjust a portion of an acoustic to electrical transfer function that characterizes an acoustic path that passes through the lavalier microphone 22. The acoustic to electric transfer function may include the effects of the path 18, the acoustic to electric (signal) transducer within the microphone 22 and a lavalier microphone filter 34 within the processor 24. Since the transducer of the microphone 22 is relatively stable, the processor 24 may detect any changes in the path 18 and adjust the filter 34 as necessary to cancel the effects produced by the path 18.

The mode of error detection may be based upon any measurement reasonably able to detect the level of deterioration caused by the acoustic path 18. Under one illustrated method, the acoustic signal 14 traveling along paths 16 and 18 may be simultaneously measured and compared to provide a set of difference values. The difference values may be used to adjust a set of coefficients within a filtering device (e.g., a Finite Impulse Response (FIR) filter) 34.

The simultaneous measurement of acoustic signals traveling along paths 16 and 18 may be accomplished by a pair of analog to digital (A/D) converters 36 within the processor 24. The sampled values may either be stored within a memory of the processor 24 or passed directly to a Fourier processor 38.

Within the Fourier processor 38, the sampled values may be subjected to a Fast Fourier Transform (FFT) to convert the signals from the time domain to the frequency domain. The Fourier conversion provides a method of determining a set of parameters that may be used to define the transfer function of the acoustic paths 18. By understanding the transfer function of the acoustic path 18 the processor 24 may correct the effects of that path within the filter 34.

In effect, the FFT conversion of a signal from the podium-mounted microphone 20 and lavalier microphone 22 provides an amplitude measurement of signal energy in each of a number of frequency spectrums within the range of the human voice. In the simplest form of the invention, a comparator 40 may be used to form a difference value for each of those spectrums. A filter processor 56 may convert the difference values into corresponding coefficients and incorporate the coefficients into the FIR filter 34. For example, if the FFT conversion indicates that the lavalier microphone 22 is 5 dB below the podium microphone 20 in the frequency range of from 3 kHz to 3.25 kHz, then a corresponding adjustment may be made to the FIR filter 34 to raise the frequency response in that range by 5 dB. Similar adjustments may be made over the other frequency ranges to achieve a one-to-one relationship between the frequency response of the podium microphone 20 and the lavalier microphone 22.

Under another illustrated embodiment, a matrix processor 42 may take the FFT values and form a transfer function matrix (M) that characterizes the acoustic path 18. The matrix processor 42 may then invert the matrix M (i.e., calculate coefficients of an inverse matrix ($M^{-1}$)). The inverse matrix (inverse transfer function) may then be incorporated into an inverse transfer function filter 44 that may operate directly on the signal from the lavalier microphone 22 to cancel the effects of the path 18 (i.e., $MM^{-1}=1$). Alternatively, the inverse transfer function may be directly incorporated into the FIR filter 34.

In another illustrated embodiment of the invention, acoustic errors present within the podium microphone 20 and lavalier microphone 22 may both be corrected. In this case, manufacture's data on microphone performance may be incorporated into a first transfer function matrix that characterizes the podium microphone 20.

As a first step, the transfer function matrix of the podium microphone 20 may be used to recover a true version of the acoustic signal 14 (in matrix format) that was actually produced at the mouth of the speaker 12. With the true version of the acoustic signal 14, a corrected transfer function may be calculated in the matrix processor 42 from the signal detected at the output of the lavalier microphone 22 that characterizes the overall transfer function of the path 18 and of the lavalier microphone 22.

The corrected transfer function may then be inverted within a filter processor 56 and incorporated into the filter 44 that cancels the effect of the path 18 and lavalier microphone 22. The corrected inverse matrix may be incorporated into the inverse transfer function matrix filter 44 or into the FIR filter 34.

Using the corrected inverse transfer function (or the other methods discussed above), the speaker 12 may approach the podium or roam throughout the area of his audience without any perceived differences in voice quality. Further, the matching or calibration of the lavalier microphone 22 may be performed automatically or upon the occurrence of a predetermined event. For example, a button 46 may be provided on or near the podium or on the processor 24 that may be activated by the speaker 12 while the speaker 12 is proximate the podium microphone 20. Activation of the pushbutton 46 may be used as a triggering event to notify the processor 24 to spectrally match the output of the lavalier microphone 22 with the speaker voice 12 or at least with the output of the podium microphone 20. Activation of the pushbutton 46 may cause the processor 24 to enter a 10 second matching routine where the spectral content of the signal from the lavalier microphone 22 may be matched with the spectral content of the podium microphone 20.

Further, it has been found that the matching can be accomplished within the processor 24 in cases of relatively large signal excursions. For example, the processor 24 has been found to work reliably with level differences of +/−10 dB.

In addition, the processor 24 may be provided with the ability to detect the presence of unmatchable signals (i.e., different in content as opposed to spectral levels). In this case, the processor may use a rolling difference threshold to identify situations where the overall difference in signal levels within respective frequency spectrum exceed some threshold value from one sample period to the next. An out of limits indicator may be activated when this situation is detected.

Under one preferred embodiment of the invention, the methods and apparatus described above may be applied to acoustic transducers, such as microphones. Under another, alternate embodiment, the term transducer may refer to any transducer or signal source. It does not have to be a microphone.

Under one illustrated embodiment of the invention, the processor 24 may be a stand-alone device with 2 inputs and 2 outputs. A first input may be the reference input (from the podium microphone 20) and the second input may be from the lavalier microphone 22. The first input may be transferred at unity gain to the first output 50. The second input may be digitally processed so that the second output 52 matches the first output 50 in level and spectral content at the end of the matching routine.

Under another illustrated embodiment, the processor 24 is incorporated into a wireless receiver for the lavalier microphone 22. A separate audio receptacle on the receiver may be provided to plug-in the podium microphone 20.

Alternatively, the processor 24 may be incorporated into an audio mixer or automatic mixer with a reference input and multiple auxiliary inputs. In this case, the auxiliary inputs are matched to the reference input, as discussed above.

A specific embodiment of a method and apparatus for matching transducer inputs according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention, any and all modifications, variations, or equivalents that fall within the true spirit and scope of the basic underlying principles disclosed and claimed herein.

The invention claimed is:

1. A method of matching an output of an auxiliary signal transducer with a reference signal transducer where the auxiliary signal transducer and reference signal transducer receive audio signals from a common signal source along different respective signal paths with different acoustical characteristics wherein the signal path of the reference signal transducer is line-of-sight and the signal path of the auxiliary signal transducer is not line-of-sight, such method comprising the steps of:

determining a signal amplitude output value provided by the auxiliary and by the reference transducers through the line-of-sight signal path of the reference transducer and the not line-of-sight signal path of the auxiliary transducer within each of a plurality of different frequency ranges in response to the audio signal received along the respective signal paths; and adjusting the signal amplitude output value of the auxiliary transducer within at least some of the plurality of different frequency ranges based upon the respective signal amplitude output value of the reference transducer.

2. The method of matching outputs as in claim 1 wherein the step of adjusting the signal amplitude output value of the auxiliary transducer further comprises providing a one-to-one ratio between the signal amplitude of the auxiliary transducer and the reference transducer within each of the plurality of frequency ranges.

3. The method of matching outputs as in claim 1 wherein the step of determining a signal amplitude output value provided by the auxiliary and by the reference transducers further comprises calculating a transfer function of the signal path through the auxiliary transducer.

4. The method of matching outputs as in claim 1 wherein the step of calculating a transfer function of the signal path through the auxiliary transducer further comprises inverting the calculated transfer function into a filter that cancels the effects of the signal path through the auxiliary transducer.

5. The method of matching outputs as in claim 1 wherein the step of determining a signal amplitude output value further comprising performing a Fourier conversion of the signal from the auxiliary signal transducer and the reference transducer.

6. The method of matching outputs as in claim 5 wherein the step of performing a Fourier conversion of the signal from the auxiliary signal transducer and the reference transducer further comprises comparing the amplitudes of the signals from the auxiliary transducer and reference transducer within each of the frequency ranges.

7. The method of matching outputs as in claim 6 wherein the step of comparing the amplitudes further comprises providing a difference value within each of the frequency ranges.

8. The method of matching outputs as in claim 5 wherein the step of providing a difference value within each of the frequency ranges further comprises determining an adjustment value for each frequency range based upon the use of a predetermined algorithm.

9. The method of matching outputs as in claim 5 wherein the step of determining an adjustment value further comprises constructing a finite impulse response filter from the adjustment values of the plurality of frequency ranges.

10. The method of matching outputs as in claim 1 further comprising defining the auxiliary transducer as a lavaliere microphone.

11. The method of matching outputs as in claim 1 further comprising defining the reference transducer as a podium-mounted microphone.

12. The method of matching outputs as in claim 1 further comprising defining the audio signal as human speech.

13. An apparatus for matching an output of an auxiliary signal transducer with a reference signal transducer where the auxiliary signal transducer and reference signal transducer receive audio signals from a common signal source along different respective signal paths with different acoustical characteristics wherein the signal path of the reference signal transducer is line-of-sight and the signal path of the the auxiliary signal transducer is not line-of-sight, such apparatus comprising:

means for determining a signal amplitude output value provided by the auxiliary and by the reference transducers through the line-of-sight signal path of the reference transducer and the not line-of-sight signal path of the auxiliary transducer within each of a plurality of different frequency ranges in response to the audio signal received along the respective signal paths; and means for adjusting the signal amplitude output value of the auxiliary transducer within at least some of the plurality of different frequency ranges based upon the respective signal amplitude output value of the reference transducer.

14. The apparatus for matching outputs as in claim 13 wherein the means for adjusting the signal amplitude output value of the auxiliary transducer further comprises means for providing a one-to-one ratio between the signal amplitude of the auxiliary transducer and the reference transducer within each of the plurality of frequency ranges.

15. The apparatus for matching outputs as in claim 13 wherein the means for determining a signal amplitude output value provided by the auxiliary and by the reference transducers further comprises means for calculating a transfer function of the signal path through the auxiliary transducer.

16. The apparatus for matching outputs as in claim 15 wherein the means for calculating a transfer function of the signal path through the auxiliary transducer further comprises means for inverting the calculated transfer function into a filter that cancels the effects of the signal path through the auxiliary transducer.

17. The apparatus for matching outputs as in claim 13 wherein the means for determining a signal amplitude output value further comprising means for performing a Fourier conversion of the signal from the auxiliary signal transducer and the reference transducer.

18. The apparatus for matching outputs as in claim 13 wherein the means for performing a Fourier conversion of the signal from the auxiliary signal transducer and the reference transducer further comprises means for comparing the amplitudes of the signals from the auxiliary transducer and reference transducer within each of the frequency ranges.

19. The apparatus for matching outputs as in claim 18 wherein the means for comparing the amplitudes further comprises means for providing a difference value within each of the frequency ranges.

20. The apparatus for matching outputs as in claim 13 wherein the means for providing a difference value within each of the frequency ranges further comprises means for determining an adjustment value for each frequency range based upon the use of a predetermined algorithm.

21. The apparatus for matching outputs as in claim 13 wherein the means for determining an adjustment value further comprises means for constructing a finite impulse response filter from the adjustment values of the plurality of frequency ranges.

22. The apparatus for matching outputs as in claim 13 further comprising means for defining the auxiliary transducer as a lavaliere microphone.

23. The apparatus for matching outputs as in claim 13 further comprising means for defining the reference transducer as a podium-mounted microphone.

24. The apparatus for matching outputs as in claim 13 further comprising means for defining the audio signal as human speech.

25. An apparatus for matching an output of an auxiliary signal transducer with a reference signal transducer where the auxiliary signal transducer and reference signal transducer receive audio signals from a common signal source along different respective signal paths with different acoustical characteristics wherein the signal path of the reference signal transducer is line-of-sight and the signal path of the the auxiliary signal transducer is not line-of-sight, such apparatus comprising:

a Fourier processor adapted to determine a signal amplitude output value provided by the auxiliary and by the reference transducers through the line-of-sight signal path of the reference transducer and the not line-of-sight signal path of the auxiliary transducer within each of a plurality of different frequency ranges in response to the audio signal received along the respective signal paths; and a filter adapted to match the signal amplitude output value of the auxiliary transducer with the signal amplitude output value of the reference transducer within at least some of the plurality of different frequency ranges.

26. The apparatus for matching outputs as in claim 25 further comprising a matrix processor adapted to calculate a transfer function of the signal path of the auxiliary transducer from the signal amplitude output values.

27. The apparatus for matching outputs as in claim 26 further comprising a filter processor adapted to invert the transfer function provided by the matrix processor into the filter.

28. The apparatus for matching outputs as in claim 25 further comprising a comparator adapted to compare the amplitudes of the signals from the auxiliary transducer and reference transducer within each of the frequency ranges.

29. The apparatus for matching outputs as in claim 25 further comprising means for defining the auxiliary transducer as a lavaliere microphone.

30. The apparatus for matching outputs as in claim 25 further comprising means for defining the reference transducer as a podium-mounted microphone.

31. The apparatus for matching outputs as in claim 25 further comprising means for defining the audio signal as human speech.

32. A method of matching an output from a portable signal transducer with a reference signal transducer where the portable signal source and reference signal source receive signals along different signal paths with different acoustical characteristics wherein the signal path of the reference signal transducer is line-of-sight and the signal path of the the auxiliary signal transducer is not line-of-sight, such method comprising the steps of:

converting a signal from each signal transducer through the respective line-of-sight signal path of the reference transducer and the not line-of-sight signal path of the auxiliary transducer within a predetermined time domain into a plurality of frequency amplitude values within a predetermined frequency domain; and adjusting a magnitude of at least some of the plurality of frequency amplitude values of the portable transducer to substantially match a corresponding set of frequency amplitude values of the reference transducer.

* * * * *